United States Patent [19]

Little et al.

[11] Patent Number: 4,723,534

[45] Date of Patent: Feb. 9, 1988

[54] HEATER HELPER

[76] Inventors: James A. Little; Blanche M. Little, both of Rte. 2, Box 430, Otis, Oreg. 97368

[21] Appl. No.: 797,516

[22] Filed: Nov. 13, 1985

[51] Int. Cl.[4] ..... F24B 13/02

[52] U.S. Cl. ..... 126/143; 126/298; 126/25 B

[58] Field of Search ..... 126/143, 152 B, 163–165, 126/298, 15 R, 12, 77, 25 B

[56] References Cited

U.S. PATENT DOCUMENTS

| | | | |
|---|---|---|---|
| 1,740,486 | 12/1929 | Wheelock | 126/298 |
| 4,050,441 | 9/1977 | Horwinski | 126/165 |
| 4,338,914 | 7/1982 | Braswell | 126/143 |

*Primary Examiner*—Carroll B. Dority, Jr.

[57] ABSTRACT

A combination fuel holder and draft channel device for use in a fireplace or wood burning stove. The fuel holder in this combination is made from ⅛ inch steel plate and its size, as well as the size of the draft channel, may vary according to the size of the fireplace or stove in which it is to be used. The fuel holder consists of a base plate that lays flat on the bottom of the firebox of the fireplace or stove. Two vertical posts, each ¾ inches wide and 6 inches high are welded on the forward edge of the base plate, each 2 inches from the center. These posts hold the wood fuel, resting on the base plate, in a compact and manageable pile for controllable combustion. The draft channel is placed between the posts and is held in position by them. The posts add versatility to the holder because pieces of 1 inch conduit pipe can be cut in lengths desired and slipped over the posts to provide added holding capacity. The draft channel is made from the same steel plate as the fuel holder. Its size may vary depending on the size of the firebox in which used. The two sides are vertical pieces, each with three air vents on the upper edge, and are welded to the under side of a top horizontal plate that is parallel to the base plate of the fuel holder. The said sides are welded inward from the outer edges of the top plate to protect the air vents from ash accumulation.

1 Claim, 3 Drawing Figures

HEATER HELPER

This invention relates to a combination fuel holder and draft channel that may be used together or separately, as needed in a fireplace or wood burning stove.

BACKGROUND OF THE INVENTION

For many years the usual method of holding fuel in a fireplace has been by the use of andirons. These provide too much air space beneath the fuel to permit proper control of the fire. This resulted in many experienced fireplace builders recommending their elimination and the building of the fire on the bottom of the fireplace. This has resulted in having a fuel pile that is difficult to keep in place. Here is where our invention fills a need. The same situation applies to the early models of stoves, such as the Earth Stove and the Blaze King, which have the rear draft in the firebox. There are many of such types of stoves in use that will be benefited by the invention.

SUMMARY OF THE INVENTION

This invention provides a solution to the problem of keeping fuel logs in proper position for most efficient combustion. The base plate lays on the bottom of the firebox with the front posts holding the fuel in place. The weight of the fuel on the base plate provides for rigidity. The posts provide for variations in placement of fuel, such as crisscrossing to enhance oxidation when a hotter fire is desired. The posts also permit the use of Presto Logs, or round timbers, without them rolling forward in an unmanagable position. The draft channel when used in a fireplace increases air supply for more intense combustion where additional heat is required. It is in rear draft stoves such as the Earth Stove and the Blaze King where the draft channel is particularly beneficial. It can be pushed against the rear draft opening and provide a means of draft free from ash obstruction.

The posts in our fuel holder are distinguishable from the andiron posts shown as Numeral 20 in FIG. 1 of Wheelock U.S. Pat. No. 1,740,486. Those are andirons such as have been used since Colonial times. They are merely decorative in this situation and are not otherwise useful. Furthermore the andirons are not fitted to a baseplate laying on the bottom of a firebox.

Our invention is likewise distinguishable from Horwinski, U.S. Pat. No. 4,050,441 which is a heat dissipating and dispersal unit with the log holding feature being incidental to the other purposes of the unit. As a fuel holder it is not separate and is not to be placed on the bottom of a firebox. This invention is something new and will be useful in the marketplace.

DETAILED DESCRIPTION OF THE INVENTION

Figure 1:
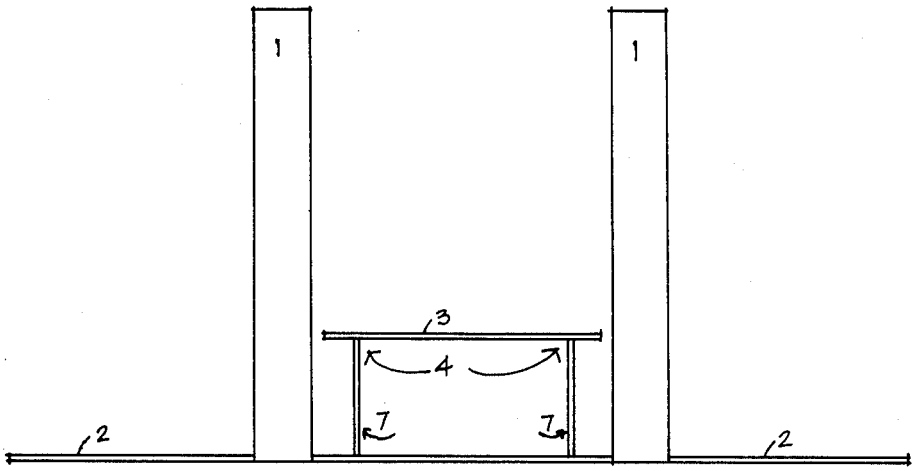
FIG. 1 is a front view.
Figure 2:
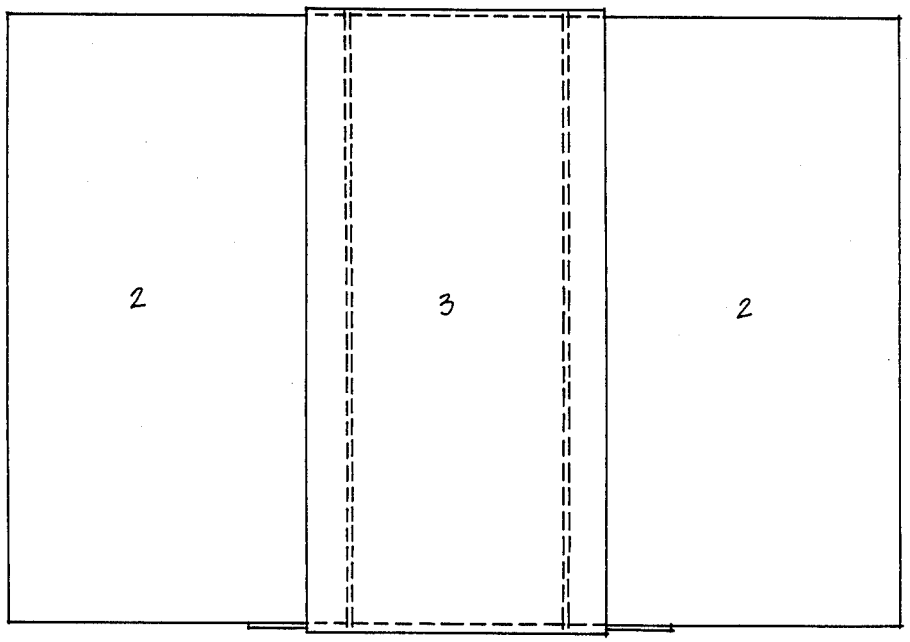
FIG. 2 is a top view.
Figure 3:
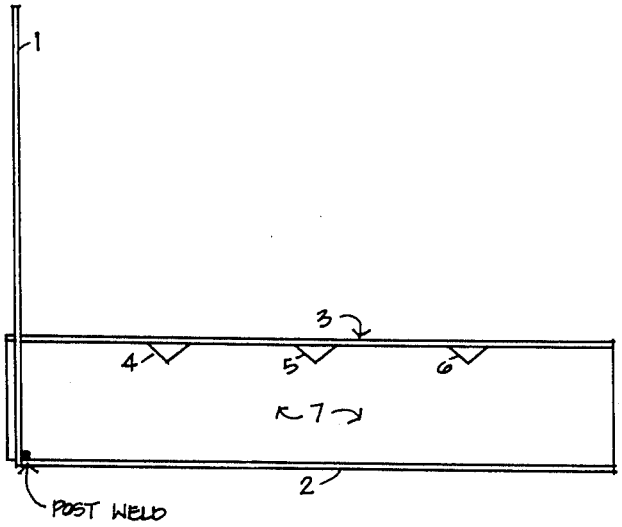
FIG. 3 is a side view.

The fuel holder is a rectangular piece of $\frac{1}{8}$ inch steel (numeral 2), to the front side of which is welded two perpindicular steel posts (numeral 1), $\frac{1}{8}$ inch thick and $\frac{3}{4}$ inch wide, each located 2 inches from center to permit the draft channel to be placed between and extending from the front side to the rear of the base plate.

The draft channel (numeral 3 and 7) is made from the same $\frac{1}{8}$ inch steel and has a flat top (numeral 3) with 2 inch high vertical pieces of steel (numeral 7) welded to the underside thereof. These vertical pieces, or sides, each have air vents (numeral 4, 5, and 6) and each is set inside $\frac{1}{2}$ inch from the outer edge of the top of the draft channel to aid in remaining free from ash obstruction.

We claim:

1. A fuel holder for insertion in a firebox comprising in combination: a substantially rectangular, planar metal base; two spaced apart post attached to one side of said metal base and extending perpendicular to said base; a planar member spaced above said metal base, extending from one of said posts to the other post and also extending the width of said metal base; spaced wall members extending between said metal base and said planar member and forming therewith a channel extending from one side of said metal base of the opposite side; and, means forming air vents in said spaced wall members.

* * * * *